United States Patent [19]

Dowding

[11] Patent Number: 4,596,232

[45] Date of Patent: Jun. 24, 1986

[54] FIREPLACE INSERT APPARATUS

[76] Inventor: Maurice H. Dowding, 2898 David Dr., Springport, Mich. 49284

[21] Appl. No.: 699,412

[22] Filed: Feb. 7, 1985

[51] Int. Cl.[4] ..... F24C 15/30

[52] U.S. Cl. ..... 126/126; 126/123; 16/19; 280/43.2

[58] Field of Search ..... 126/123, 126; 16/19, 16/32, 33; 248/129; 280/43.1, 43.2

[56] References Cited

U.S. PATENT DOCUMENTS

| | | | |
|---|---|---|---|
| 129,550 | 7/1872 | Harding | 16/32 |
| 318,865 | 5/1885 | Burgess et al. | 280/43.2 |
| 1,343,650 | 6/1920 | Snyder | 280/61 |
| 2,187,879 | 1/1940 | Johnson | 280/43.2 X |
| 2,742,892 | 4/1956 | Herzer | 126/4 |
| 3,437,346 | 4/1969 | Cobb | 280/43.2 |
| 4,068,650 | 1/1978 | Nelson | 126/121 |
| 4,138,987 | 2/1979 | Fromman | 126/120 |
| 4,230,092 | 10/1980 | Henriques | 126/126 |
| 4,319,558 | 3/1982 | Thurlo | 126/121 |

FOREIGN PATENT DOCUMENTS

| | | | |
|---|---|---|---|
| 215199 | 10/1960 | Austria | 280/43.2 |

*Primary Examiner*—James C. Yeung
*Assistant Examiner*—Allen J. Flanigan
*Attorney, Agent, or Firm*—Beaman & Beaman

[57] ABSTRACT

The invention pertains to fireplace insert apparatus and particularly relates to the use of anti-friction rollers for aiding insert installation. Guides are mounted upon the opposite sides of a fireplace insert each receiving a bracket slidable in an oblique direction by a threaded rod adjustment. Rollers mounted upon the brackets support the rear region of the insert during installation, the inclination of bracket adjustment rod permits access from the insert front region, and the bracket is retained within its guide by a friction detent.

6 Claims, 4 Drawing Figures

FIREPLACE INSERT APPARATUS

BACKGROUND OF THE INVENTION

Fireplace inserts have become popular in view of high fuel oil and natural gas prices. Such inserts normally consist of a heavy steel or cast iron wood burning furnace or stove-like apparatus which is placed within the fireplace opening. The insert includes conduits for air circulation, often electric fan induced, whereby air warmed by the wood or coal fire within the insert may be released into the adjacent room, thereby substantially increasing the heat emitting characteristics of the fireplace.

Due to the bulky and extensive metal content of fireplace inserts, they are very heavy, and the installation thereof usually requires several relatively skilled installers of sufficient strength to slide the insert into the fireplace opening until proper positioning is achieved. The sliding of the insert bottom panel, or fixed legs, over the fireplace floor results in high friction causing considerable difficulty during installation.

Fireplace devices utilizing wheels to improve portability are known, such as shown in U.S. Pat. Nos. 2,742,892 and 4,138,987, but such apparatus is difficult to use and is not as versatile as desirable. For instance, due to limited clearance within the fireplace opening known apparatus cannot be readily adjusted when the insert is in location, or finally positioned.

It is an object of the invention to provide apparatus which facilitates the installation of a fireplace insert into the fireplace opening minimizing the manpower and force necessary for installation.

Another object of the invention is to provide fireplace insert apparatus utilizing anti-friction rollers or wheels wherein the vertical positioning of the rollers to the insert body may readily be adjusted, and may be adjusted even when the insert is fully installed, or substantially in place, within the fireplace opening.

Another object of the invention is to provide fireplace insert apparatus permitting anti-friction support of the rear region of a fireplace insert to facilitate installation which is of an economical nature, of high strength, readily assembled and diassembled to the insert, and resists inadvertent disassembly.

In the practice of the invention a typical fireplace insert includes a body having front and rear regions, top and bottom panels and lateral sides, and the apparatus of the invention is attached to the insert body lateral sides in the vicinity of the rear wall and bottom panel. A U-shaped guide is affixed to the lateral sides defining a guideway passage obliquely related to the vertical and an elongated bracket is slidably received within the guide passage.

The lower end of the bracket rotatably supports a roller on an axle perpendicular to the associated insert side wall, and movement of the bracket within the guide raises and lowers the roller relative to the insert body bottom panel in an oblique direction to the vertical wherein lowering of the bracket and roller moves the roller closer to the insert rear wall.

Adjustment of the bracket within the guide is through a threaded shaft and nut arrangement wherein the nut is fixed to the guide and the end of a threaded shaft engages an abutment defined on the bracket. A knurled head on the threaded shaft disposed toward the insert upper panel and front region permits manual rotation of the rod to adjust the bracket within the guide and vertically adjust the roller relative to the insert body.

A tang lanced from the metal of the guide frictionally engages the bracket retaining the bracket within the guide when no load is imposed upon the rollers assuring assembly retension of the bracket and guide when the insert is lifted and otherwise handled.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
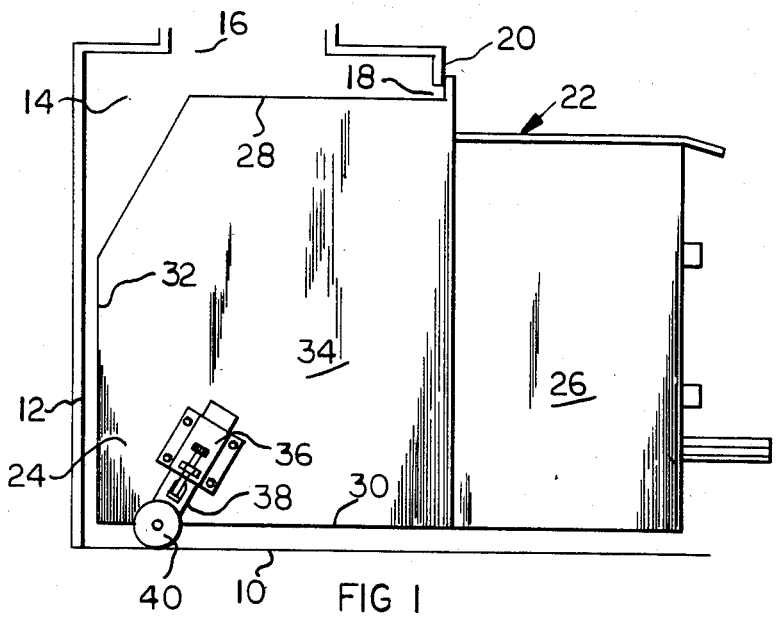
FIG. 1 is a side elevational view of a fireplace insert utilizing the apparatus of the invention as fully installed within a fireplace opening.

With reference to FIG. 1, a typical fireplace is illustrated wherein the fireplace includes a floor 10, a rear wall 12, side walls 14, and an upper wall in which the chimney opening 16 is defined. The fireplace face opening 18 includes the upper face piece 20.

A typical fireplace insert is generally indicated at 22 and consists of a heavy metal body usually formed of welded steel plate or cast iron. The body includes a rear region 24, a front region 26 and upper or top panel 28, a bottom panel 30, rear panel 32 and spaced parallel lateral side walls 34, one of which is visible in FIG. 1. The insert 22 will normally weigh several hundreds of pounds, and is sized to be received within the fireplace opening 18. The fireplace insert includes a combustion chamber in which wood or coal are consumed, and the insert usually includes a double wall surrounding the combustion chamber through which air may be circulated by convection or fan induced, heated and discharged through the front region into the room served by the fireplace. The particular details of the fireplace insert are standard and will form no part of the present invention. The anti-friction support apparatus of the invention may be used with most fireplace insert configurations, and it will be appreciated that the illustrated insert 22 is for purpose of illustration only.

Figure 2:
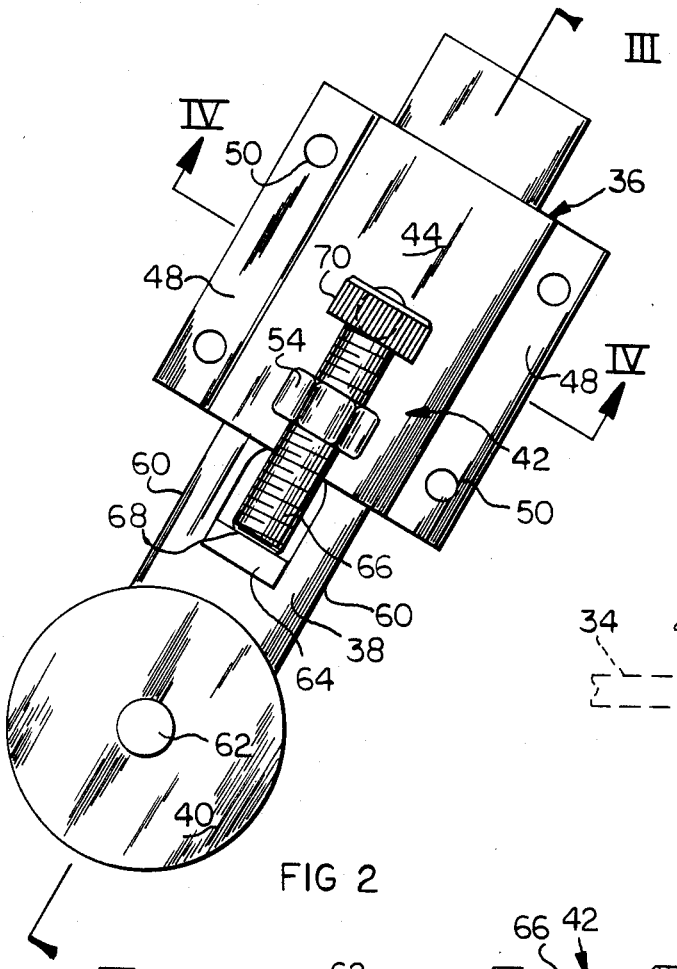
FIG. 2 is an enlarged, side elevational view of the insert adjustment apparatus constituting the subject matter of the invention.
Figure 3:
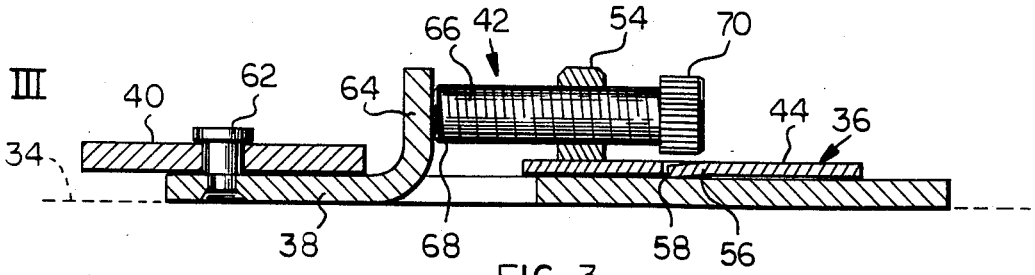
FIG. 3 is an elevational, sectional view taken through the guide and bracket along Section III—III of FIG. 2.

The apparatus of the subject matter which is attachable to the insert to facilitate installation is best shown in FIGS. 2 and 3. This apparatus generally includes a guide 36, a bracket 38, a roller 40 and adjustment structure 42.

Figure 4:
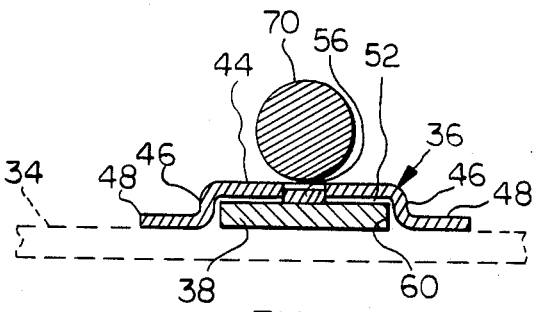
FIG. 4 is an elevational, sectional view through the guide and bracket taken along Section IV—IV of FIG. 2.

The guide 36 is formed of sheet metal and is of a generally U-shaped configuration as appreciated from FIG. 4. The guide includes a base 44, legs 46 depending from the base, and outwardly extending flanges 48 depend from the legs. The flanges 48 include holes 50 whereby bolts or screws may be used to attach the guide to the lateral sides 34 of the fireplace insert. It is to be understood that roller units are attached to each of the two lateral sides 34 of the insert, and the apparatus on each side wall is identical and similarly assembled.

Internally, a guide passage 52 is defined within the guide between the base 44, the legs 46 and the flat lateral side 34 of the insert. The inner surfaces of the base and the legs define guide surfaces for the roller bracket, and it will be appreciated that the legs 46 are parallel to each other, and the base 44 is parallel to the adjacent insert side wall.

A nut 54 is welded to the exterior surface of the base 44 and a portion of the base is lanced to define a tang 56 having a free end 58, FIG. 3, which is deflected inwardly into passage 52. The tang 56 provides frictional engagement with the roller bracket as later described.

The guide 36 receives the elongated bracket 38 which is of a planar configuration having parallel sides 60 separated by a distance slightly less than the inner surfaces of the guide legs 46, and likewise, the thickness of the bracket 38 is slightly less than the thickness of the separation between the base 44 and the insert side wall. In this manner, the bracket is received within the guide passage 52 for adjustment in the longitudinal direction.

At the lower region of the bracket the roller 40 is rotatably mounted thereon by axle rivet 62, FIG. 3. The roller may be formed of metal sheet stock and the axle is of sufficient dimensions, as is the roller thickness and bracket, to support the weight applied thereto when installing the associated fireplace insert.

The central portion of the bracket 38 is lanced to define an abutment 64 outwardly formed to extend at right angles to the plane of the bracket.

The adjustment structure 42 includes the threaded rod 66 received within the nut 54 having a lower end 68 which engages the bracket abutment 64 as will be appreciated from FIG. 3. The outer end of the rod comprises a head 70 which may be knurled to facilitate manual rotation with the fingers, or the head 70 could include a screwdriver slot or be of a hexagonal configuration for permitting a wrench to be applied thereto.

It is often desirable that adjustment of the vertical position of the rollers 40 relative to the insert 22 be made when the insert body is located within the fireplace opening 18, and in such instance, access to the threaded rod head 70 is necessary. Thus, the guide 36 is mounted upon the associated insert side wall 34 at an oblique angle to the vertical wherein the guide and bracket 38 have a vertical vector so that the lowermost part of the roller 40 may be adjusted relative to the insert bottom panel 30 to permit support of the insert on the rollers during insert installation.

As the free end 58 of the guide tang 56 is deformed inwardly of the base 44 the tang will engage the bracket 38 frictionally forcing the bracket against the adjacent side wall frictionally holding the bracket within the guide 36. Thus, tang 56 will prevent the bracket from falling from the guide passage 52 during handling and transport of the insert 22 when no load is being imposed on the rollers.

In use, the threaded rods 66 are initially adjusted so that the lower portion of the rollers 40 extend below the insert bottom panel 30, and with the rollers so adjusted the insert 22 may be readily "rolled" into the fireplace opening 18 wheelbarrow fashion. The use of the anti-friction rollers 40 substantially reduces the effort and manpower required to install the fireplace insert in the fireplace, and the rollers readily permit "jockeying" and other minor movements of the insert to position the same as desired. Once the insert is properly positioned, if desired, the insert mauy be lowered by rotating the threaded rods 66 through heads 70 which retracts the rollers and bracket into the guide permitting the insert bottom panel 30 to rest upon the fireplace floor.

As the clearance between the lateral sides 34 of the insert and the fireplace sides 14 may be restricted, the oblique orientation of the guides 36 and the rods 66 permits access to the threaded rod even though the clearances may be small. To remove the insert 22, the rods may be rotated to extend the brackets 38 and rollers 40 for supporting the weight of the insert rear region on the rollers which will facilitate insert removal.

The all-metal construction of the apparatus of the invention prevents damage due to the heat of the insert, and the disclosed apparatus may be economically manufactured and assembled. It is appreciated that various modifications to the inventive concepts may be apparent to those skilled in the art without departing from the spirit and scope of the invention.

I claim:

1. In a fireplace insert adapted to be placed within a fireplace opening having a substantially horizontal floor, the insert including a body having a front region, a rear region, a rear wall, lateral side walls, a top panel and a bottom panel, the improvement comprising, a U-shaped guide mounted upon each body side wall adjacent the rear wall, each guide including a base having spaced parallel legs depending therefrom, said base and legs defining guide surfaces having a vertical orientation, means affixing said legs to an insert body side wall, an elongated bracket slidably mounted within said guide between said guide surfaces and the adjacent insert body side wall, said bracket including an upper region and a lower region, a roller rotatably mounted upon said bracket lower region having an axis substantially perpendicular to the adjacent side wall, the lowermost portion of said rollers extending below the insert body bottom panel, and elongated threaded rod adjustment means interposed between said guide and said bracket substantially parallel to the length of said bracket adjusting the position of said bracket within said guide and the vertical orientation of said roller to the bottom panel.

2. In a fireplace insert as in claim 1, said threaded rod adjustment means comprising a nut mounted upon said guide base, a threaded rod threaded within said nut having first and second ends, an abutment defined on said bracket, said rod first end being mechanically connected to said abutment, and torque transmitting means defined on said rod second end.

3. In a fireplace insert adapted to be placed within a fireplace opening having a substantially horizontal floor, the insert including a body having a front region, a rear region, a rear wall, lateral side walls, a top panel and a bottom panel, the improvement comprising, a guide mounted upon each body side wall adjacent the rear wall, each guide defining guide surfaces having a vertical orientation, an elongated bracket slidably mounted within said guide supported therein by said guide surfaces, said bracket including an upper region and a lower region, a roller rotatably mounted upon said bracket lower region having an axis substantially perpendicular to the adjacent side wall, the lowermost portion of said rollers extending below the insert body bottom panel, and elongated threaded rod adjustment means interposed between said guide and said bracket substantially parallel to the length of said bracket adjusting the position of said bracket within said guide and the vertical orientation of said roller to the bottom panel, said threaded rod adjustment means comprising a nut mounted upon said guide, a threaded rod threaded within said nut having first and second ends, an abutment defined on said bracket, said rod first end being mechanically connected to said abutment, and torque transmitting means defined on said rod second end, said guide surfaces being obliquely inclined to the vertical wherein said bracket upper region extends toward the insert body top panel and front region, and said rod second end being disposed toward said bracket upper region and body front region for access from said body front region.

4. In a fireplace insert as in claim 3, said torque transmitting means defined on said rod second end comprising a knurled head.

5. In a fireplace insert as in claim 2, said rod first end abutingly engaging said abutment, and friction producing means interposed between said guide and said bracket biasing said bracket into frictional engagement with the adjacent body side wall, said frictional engagement retaining said bracket within said guide when no weight is imposed upon said rollers.

6. In a fireplace insert as in claim 5, said friction producing means comprising a tang lanced from said guide base frictionally engaging said bracket.

* * * * *